US005642672A

United States Patent [19]

Isozaki et al.

[11] Patent Number: 5,642,672

[45] Date of Patent: Jul. 1, 1997

[54] PRINT IMAGE TREATMENT DEVICE

[75] Inventors: Takashi Isozaki; Takahito Tojima; Ryuji Higa; Sadanao Okuda, all of Ibaraki-ken, Japan

[73] Assignee: Riso Kagaku Corporation, Tokyo, Japan

[21] Appl. No.: 617,093

[22] Filed: Mar. 18, 1996

[30] Foreign Application Priority Data

Mar. 29, 1995 [JP] Japan ..... 7-071896

[51] Int. Cl.[6] ..... B41F 35/02

[52] U.S. Cl. ..... 101/424.2; 101/416.1; 101/350

[58] Field of Search ..... 101/114, 117, 101/118, 129, 416.1, 417, 418, 423, 424, 425, 424.2, 483; 427/333; 118/46, 56, DIG. 1

[56] References Cited

U.S. PATENT DOCUMENTS 3,861,351 1/1975 Bonwit et al. ..... 101/424.2

4,836,129 6/1989 Dahlgren ..... 101/424.2

5,476,043 12/1995 Okuda et al. ..... 101/483

*Primary Examiner*—Christopher A. Bennett

*Attorney, Agent, or Firm*—Kanesaka & Takeuchi

[57] ABSTRACT

Disclosed is the print image treatment device formed of: a contact member on a surface of which an excessive ink removing liquid not dissolving in a printing ink forming a print image and having a lower surface tension than that of the printing ink is applied, the contact member being driven to rotate; a facing member for bringing a printed surface of a printing body into contact with the excessive ink removing liquid on the contact member by nipping and carrying the printing body having been printed between the contact member and the facing member; a supply device for supplying the excessive ink removing liquid to the contact member; and a cleaning device for removing an excessive ink with the excessive ink removing liquid. The nip width formed by the contact member and the facing member, which is defined as the dimension of the part with which the contact member and the facing member are in contact in the direction of the printing body being carried, is specified to be 0.5 mm or over.

8 Claims, 5 Drawing Sheets

FIG. 5

| | DEFORMATION OF PRINT IMAGE (RUBBING RESISTANCE) | SET OFF |
|---|---|---|
| EXAMPLE 1 | ○ | ○ |
| EXAMPLE 2 | ○ | ○ |
| EXAMPLE 3 | ○ | ○ |
| COMPARISON EXAMPLE | × | × |

PRINT IMAGE TREATMENT DEVICE

BACKGROUND OF THE INVENTION

The present invention relates to a print image treatment device used in a stencil printing device or the like. The present invention is effective as a measure particularly for a set-off and seeping-through in printing.

In printing using liquid printing ink, there have been problems: a set-off, a symptom that a printing ink forming a print image on a printed body sticks to the back surface of another placed thereon, when printed bodies are piled up immediately after printing; a print image deformation occurring when a finger slightly touches a print image surface immediately after printing; and a seeping-through, a symptom that a printing ink forming a print image on a printing body, such as a sheet and printing paper penetrates through the printing body to the back surface.

These problems as mentioned above are apt to appear particularly in a stencil printing which uses excessive quantity of printing ink, in forming a print image on a printing body compared to the other type of printing.

Efforts have been made to reduce an applied quantity of ink to a printing body on printing processes to prevent a set-off, seeping-through, or the like from occurring. However, it is difficult to quantitatively control ink; over-controlling an applied quantity of ink will cause a print image to be thin or to blur, and will lower the printing quality.

To avoid problems as mentioned above, it is considered to heat and dry a printing ink forming a print image, but this method needs to use a heater having a considerably high power. When a drying means by a heater or the like dries a printing body, conditions imposed on the drying means are more strict as the printing speed of a printing machine gets higher. Practically, it is impossible to dry a printing ink in such a high speed as to prevent a set-off, seeping-through, or the like from occurring.

Furthermore, depending on a printing system, a fine powder such as starch or talc can be applied to a print image for preventing a set-off. However, such a device as to apply these fine powders uses compressed air; a printing device having this type of device is apt to be considerably large.

And, when a printing body is transferred to a discharge paper tray, sorter, or the like after printing, it is impossible to allow a transfer roller to touch a print image on the printing body to keep the print image in a good condition. Thus, a conveyer belt has been used to transfer the printing body by a transfer mechanism touching only with the back surface (non-printed surface) of the printed body. The printed body transfer device of this type has been disclosed in, for instance, Japanese Patent Laid Open No. 50-88769.

However, compared to a transfer system used in a PPC copy machine or the like that transfers a copying paper forcibly by nipping both sides, the system transferring a printing body without touching the print image surface, but touching the back surface only, creates irregularities in paper setting in a transferred place such as a discharged paper tray or sorter; consequently deteriorating the neatness of a discharged paper. This tendency is more obvious as a printing speed, in other words, a paper discharging speed becomes higher. And, these problems drastically reduce the degree of freedom for designing a paper carrying and discharging path in the printing device.

SUMMARY OF THE INVENTION

The inventors of the present invention invented a new device that removes an excessive printing ink from a printing body to enhance the quality of printing. This device comprises a contact roller on the surface of which an excessive ink removing liquid is applied in a layered form while rotating, and a facing roller to face with the contact roller; and nips to carry the printing body by the contact roller and facing roller. And, it transfers the excessive printing ink of the print image on the printed body to the excessive ink removing liquid applied in a layered form on the contact roller; the excessive printing ink on the contact roller is removed by a cleaning means such as a blade being in contact with the contact roller.

The present invention intends to improve the aforementioned excessive ink removing device based on the inventors' proposal; aiming at reliably preventing a set-off, seeping-through or the like from occurring on the printing body without other faults induced; and therefore, it is an object of the present invention to provide a print image treatment device capable of removing the excessive printing ink of the print image more reliably.

The print image treatment device in the first aspect of the invention comprises a contact member to be rotated, on a surface of which an excessive ink removing liquid not dissolving in a printing ink forming a print image and having a lower surface tension than that of the printing ink is applied, a facing member for bringing a printed surface of a printing body into contact with the excessive ink removing liquid on the contact member by nipping and carrying the printing body having been printed between the contact member and the facing member, a supply means for supplying the excessive ink removing liquid to the contact member, a cleaning means for removing an excessive ink with the excessive ink removing liquid. The dimension of the part with which the contact member and the facing member are in contact in the direction of the printing body being carried is specified to be 0.5 mm or over.

The print image treatment device in the second aspect of the invention is that, in the print image treatment device as claimed in the first aspect, at least one of the contact member and the facing member is comprised of an elastically deformable material, the contact member and the facing member come into contact with each other while not carrying the printing body, and at least one of the contact member and the facing member deforms elastically.

The print image treatment device in the third aspect of the invention is that, in the print image treatment device in the second aspect, the cleaning means is formed of a plate member being in contact with a surface of the contact member on the front side of the top, in the rotating direction of the contact member.

The print image treatment device in the fourth aspect of the invention is that, in the print image treatment device as claimed in the third aspect, the supply means supplies the excessive ink removing liquid on a surface of the contact member on the front side of the contact position formed by the plate member and the contact member, in the rotating direction of the contact member.

The print image treatment device in the fifth aspect of the invention is that, in the print image treatment device as claimed in the fourth aspect, a sheet elastic body for recovering the excessive ink removing liquid is in contact with a surface of the contact member on the front side of the contact position formed by the plate member and the contact member, in the rotating direction of the contact member.

The print image treatment device in the sixth aspect of the invention is that, in the print image treatment device as claimed in the fifth aspect, the end part of the sheet elastic body comes into close contact with a surface of the contact member with a specified length, and the rear part is placed at a lower position to guide downward the excessive ink removing liquid on the surface of the contact member.

The print image treatment device in the seventh aspect of the invention is that, in the print image treatment device as claimed in the first aspect, the contact member is comprised of an endless belt loaded on a plurality of rollers.

The print image treatment device in the eighth aspect of the invention is that, in the print image treatment device as claimed in the first aspect, the contact member is a contact roller to nip the printing body already printed between the facing member and the contact member.

The constitution as claimed in the foregoing leads at least to the following actions.

The excessive ink removing liquid applied on the surface of the contact member comes into contact with the surface of the print image on the printing body. The excessive part of the printing ink forming the print image is transferred to the layer of the excessive ink removing liquid on the contact member, and is removed from the printing body. The excessive ink removing liquid does not dissolve in the printing ink forming the print image, and is a liquid having a lower surface tension than that of the printing ink. Thus, the excessive printing ink transferred to the layer of the excessive ink removing liquid is in a floating state on the surface of the excessive ink removing liquid. As the contact member rotates, the excessive part of the printing ink being in a floating state on the surface layer of the contact member is removed from the contact member with the excessive ink removing liquid by a cleaning means being in contact with the surface of the contact member. Since the nip width between the contact member and the facing member, or the length of the part where the contact member is in contact with the facing member in the direction of the printing body being carried, is specified to be 0.5 mm or over, the excessive part of the printing ink is completely removed. Consequently, the set-off and seeping-through are reduced. Since the excessive printing ink is not present on the surface of the printing body thus having been treated, the device based on this constitution provides the print image not blurred even when touched by a finger immediately after printing.

BRIEF DESCRIPTION OF THE DRAWINGS

FIG. 5 is an evaluation chart comparing the embodiments of the present invention and the other comparison example regarding the deformation of the print image (rubbing resistance) and the set-off.

DETAILED DESCRIPTION OF THE PREFERRED EMBODIMENTS

Figure 1:
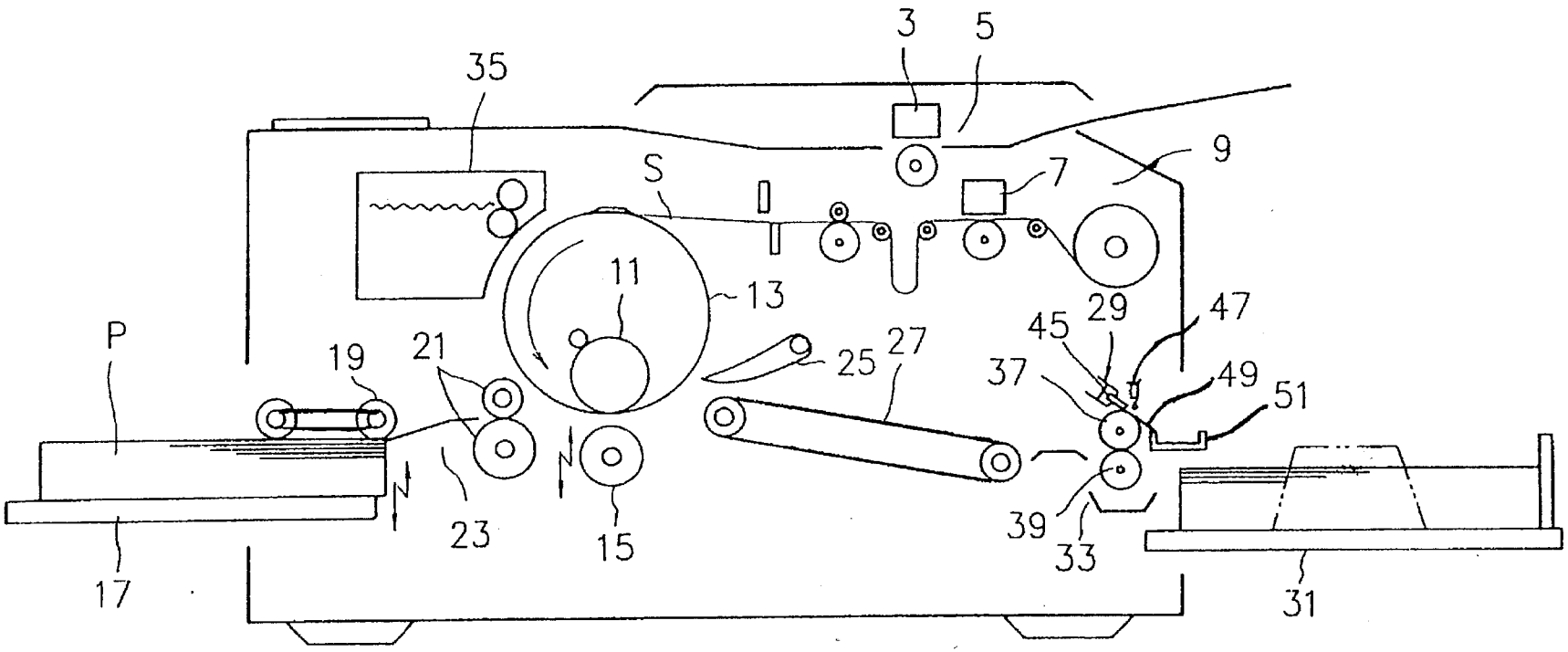
FIG. 1 is a plan view illustrating the constitution of one embodiment based on the present invention.

The constitution of the stencil printing device used in the first embodiment will be described with reference to FIG. 1 and FIG. 2. A copy image reader 5 has an image scanner 3 to read out a copy image for printing. A stencil making unit 9 has a stencil making device 7 to form a perforated image on a stencil sheet S for the stencil printing according to a copy image data read out by the copy image reader 5.

The stencil sheet S for the stencil printing perforated by the stencil making unit 9 is wound up around the circumference of a cylindrical printing drum 13. Inside the printing drum 13, an ink supplier 11 including an ink squeegee is installed to supply ink to the inner surface of the printing drum 13. A press roller 15 movable up and down is placed under the printing drum 13. The press roller 15 and the printing drum 13 nip and carry a printing body P (e.g. a sheet, such as printing paper) supplied between them to form a print image on the printed body P.

In a paper supply part 23, a paper feeder roller 19 feeds one by one the printing bodies P placed on a paper supply base 17, and the printing body P is fed between the press roller 15 and the printing drum 13 by a paper supply timing roller 21.

In a paper discharging part 33, a peeling claw 25 peels off the printing body P from the printing drum 13. The printing body P having been peeled off is carried to the print image after treatment device 29 by a conveyer 27 having a belt conveying mechanism. The print image after treatment device 29 removes an excessive ink from the print image on the printing body P. The printed body P having been treated is discharged and piled up onto a discharged paper tray 31.

The stencil sheet S for the stencil printing, after printing, is taken off from the printing drum 13 by a plate discharging part 35, and is disposed.

The printing operation will now be described based on the foregoing constitution. The printing drum 13 rotates about the central axis of itself counterclockwise in the drawing by a driving means not illustrated in the drawing. The printing body P is carried, at a given timing synchronized with the rotation of the printing drum 13, from left to right in the drawing by the paper supply timing roller 21, and is fed into between the printing drum 13 and the press roller 15. The printing body P is pressed by the press roller 15 toward the stencil sheet S wound around the circumference of the printing drum 13, on which the stencil printing is applied.

The printing body P already printed is peeled off from the printing drum 13 by the peeling claw 25 and is guided to the print image treatment device 29 with the print image upward by the conveyer 27 for conveying paper. The printing body P is treated by the print image treatment device 29; is carried to the discharged paper tray 31 and piled up thereon.

The constitution and action of the print image treatment device 29 will now be described. As illustrated in FIG. 2, the print image treatment device 29 has a contact roller 37 for the contact member which comes into contact with the print image surface on the printing body P already printed, and a facing roller 39 to face the contact roller 37. The contact roller 37 and the facing roller 39 are supported by spindles 41 and 43 in parallel and rotatably, respectively. The facing roller 39 is energized upward, toward the contact roller 37 by a spring as an energizing means not illustrated in the drawing. When the printing body P is not present between the contact roller 37 and the facing roller 39, the contact roller 37 and the facing roller 39 are in contact with each other.

A blade 45, i.e. a plate member having an approximately rectangular cross section is in contact with a circumference 37*a* (excessive ink remover applied surface) of the contact roller 37. The base end part of the blade 45 is fixed at an end of a metal member, and the end part of the blade 45 is in contact with the contact roller 37. The blade 45 is placed slightly above the top of the contact roller 37, and the lower corner part of the end part is in contact with the circumference 37*a* of the contact roller 37 on the front side of the top of the contact roller 37 in the rotating direction.

An excessive ink removing liquid supplying nozzle 47 is placed on the front side of the position where the contact roller 37 is in contact with the blade 45 in the rotating direction, above the circumference 37*a* of the contact roller 37. The excessive ink removing liquid supplying nozzle 47 is a means for supplying the excessive ink removing liquid onto the circumference 37*a* of the contact roller 37. The excessive ink removing liquid does not dissolve in the printing ink to form the print image, and has a lower surface tension than the printing ink.

When the excessive ink removing liquid supplying nozzle 47 is operated for supplying the excessive ink removing liquid onto the circumference 37*a* of the contact roller 37, the excessive ink removing liquid remains between the blade 45 and the contact roller 37. As the contact roller rotates, the excessive ink removing liquid passes through between the contact roller 37 and the blade 45 forming a layer on the surface of the contact roller 37. At this time, the blade 45 functions so as to even the quantity of the excessive ink removing liquid applied on the circumference 37*a* of the contact roller 37. Furthermore, the blade 45 functions as a cleaning means for removing dirts on the circumference 37*a* of the contact roller 37.

A sheet elastic body 49 is placed as a recovery means for the excessive ink removing liquid on the front side of the blade 45 in the rotating direction of the contact roller 37. The sheet elastic body 49 is a sheet member having a specific elasticity. The front end part of the sheet elastic body 49 is in contact with the circumference 37*a* of the contact roller 37 at a contact point (d) positioned on the front side of the contact position of the contact roller 37 with the blade 45 in the rotating direction of the contact roller 37. The sheet elastic body 49 is placed at a position nearer the contact roller 37 than the tangent (e) at the contact point (d) of the contact roller 37; the rear end part is at a position lower than the front end part. Therefore, a part of the front end of the sheet elastic body 49 comes into close contact with the circumference 37*a* of the contact roller 37 with a certain length; therefore, the above-mentioned front end part of the sheet elastic body 49 is elastically deformed according to the shape of the circumference 37*a* of the contact roller 37.

The rear end of the sheet elastic body 49 is fixed to a plate member 51 for receiving the excessive ink removing liquid placed at a lower position than the contact point (d). The front end of the sheet elastic body 49 is not fixed; and is in contact with the contact roller 37 as mentioned above. Thus, the sheet elastic body 49 is slant such that the free front end is in contact with the contact roller 37 and the fixed rear end is positioned downward.

The excessive ink removing liquid used in this embodiment does not dissolve in the printing ink to form the print image on the print image surface of the printing body P, and the remover is a liquid having a surface tension lower than that of the printing ink. There are liquids to meet this condition, for instance, dimethyl-siliconoil, and modified-siliconoil with phenyl, polyether, fluorine, amino, epoxy, carboxyl, carbinol, methacryl, mercapto, or phenol.

Furthermore, aqueous solutions with a surface active agent or an organic solvent added to the above liquid can be used for the excessive ink removing liquid.

As a surface active agent to be added in water, there are anion, cation, and ampholytic ionic and nonionic surface active agents. The addition rate of each of these surface active agents is determined so that the surface tension of the excessive ink removing liquid is lower than that of the printing ink.

As an organic solvent to be added in water, a water-soluble organic solvent, may be used, such as methanol, ethanol, isopropyl alcohol, n-isopropyl alcohol, ethylene glycol, and glycerin.

The excessive ink removing liquid should be applied uniformly on the circumference 37*a* of the contact roller 37, and the application thickness is preferably 0.0001–1 μm. This is approximately equivalent to 0.1–100 mg/B4 size, when converted into the application amount on the printing body. In order to control the application thickness in such a degree, the viscosity of the excessive ink removing liquid needs to be kept lower than 5000 CPS as mentioned above.

The contact roller 37, facing roller 39, and blade 45 are comprised of a material which does not create decomposition such as swelling by the excessive ink removing liquid. When the basis material for the excessive ink removing liquid is, for instance, siliconoil; the contact roller 37, facing roller 39, and blade 45 are preferably comprised of fluorocarbon resin (rubber), phenyl metamorphic silicon resin (rubber), urethane rubber, or the like.

Figure 3:
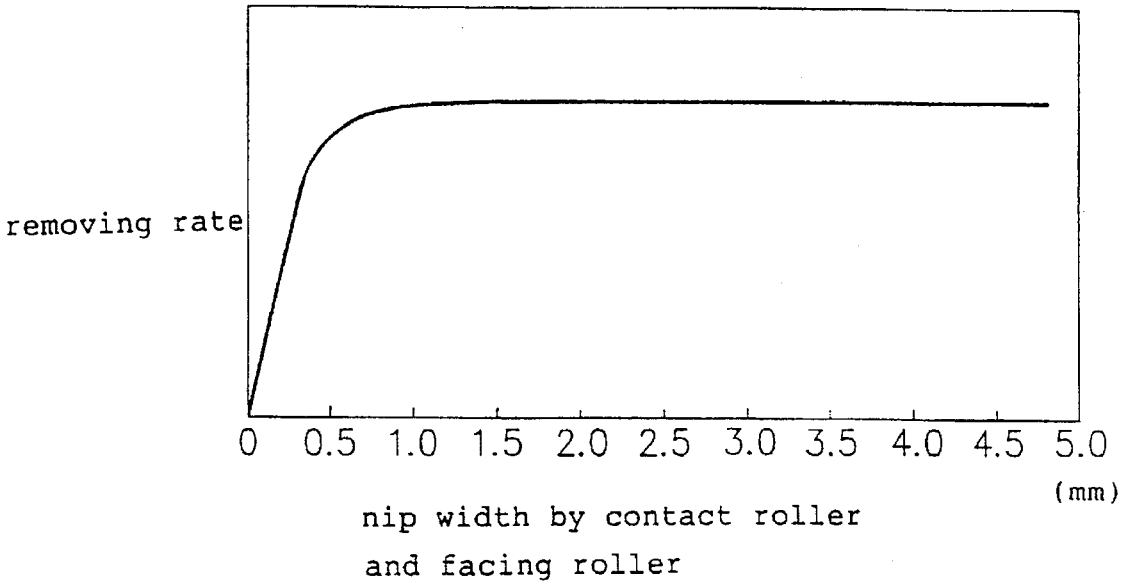
FIG. 3 is a graph representing the relation between the nip width and the ink removing rate in the one embodiment.

At least one of the contact roller 37 and the facing roller 39 is comprised of the foregoing rubber materials with elasticity. And, the contact roller 37 and the facing roller 39 are in contact with each other in such a state that a part of at least one of them is elastically deformed in a static state without nipping the printing body. The length of the part with which both the rollers 37 and 39 are in contact in the direction that the printing body is carried is called the nip width. According to the knowledge acquired by the inventors from the experiment results as will be mentioned later, there is a certain relation between the nip width and the ink removing rate, as illustrated in FIG. 3 for an example. Here, the ink removing rate is defined as the value of the ink amount having been transferred to the contact roller (excessive printing ink amount) divided by the printing ink amount on the printing body not transferred yet to the contact roller 37; where, the printing body is a wood free paper.

As illustrated in FIG. 3, as long as the nip width is lower than approximately 0.5 mm, the ink removing rate rises as the nip width is enlarged. When the nip width is over 0.5 mm, the excessive printing ink on the printed body is completely transferred to the contact roller 37; therefore, the ink removing rate is saturated as illustrated in FIG. 3. Thus, it is necessary to set the nip width at 0.5 mm or over for completely removing the excessive printing ink.

To set the nip width formed by the contact roller 37 and the facing roller 39 to 0.5 mm or over, it is necessary to select an appropriate material for both the rollers 37 and 39 and to appropriately set the diameters of both the rollers 37 and 39 and the dimension between the axes. As for the material, besides the foregoing rubbers, foamed sponge will be used.

The action of the print image treatment device 29 constituted as above will now be described. The contact roller 37 and the facing roller 39 nip and carry the printing body P already printed. The film (a) of the excessive ink removing liquid formed on the circumference 37*a* of the contact roller 37 comes in contact with the print image surface on the printed body P. This contact transfers the excessive part of the printing ink (b) forming the print image on the printing body P to the film (a) of the excessive ink removing liquid on the contact roller 37; the excessive part of the printing ink is removed from the printing body P. The surface temperature of the contact roller 37 is kept in the range of 25° C. which is suitable for transferring the excessive printing ink; therefore, the excessive printing ink on the printing body P is transferred to the contact roller without remaining the excessive printing ink on the printing body P.

The printing ink (c) having been transferred to the film (a) of the excessive ink removing liquid on the contact roller 37 passes through a part where the sheet elastic body 49 and the contact roller 37 are in sliding contact with each other with the rotation of the contact roller.

The excessive ink removing liquid used in this embodiment does not dissolve in the printing ink (b) forming the print image, and is liquid having a surface tension lower than that of the printing ink (c). Thus, the excessive part of the printing ink having been transferred to the excessive ink removing liquid is in a floating state on the surface of the excessive ink removing liquid.

The film (a) of the excessive ink removing liquid containing the excessive printing ink (c) having been transferred to the contact roller 37 is scraped off by the blade 45. With the rotation of the contact member, the excessive part of the printing ink is removed with the excessive ink removing liquid from the surface of the contact roller 37 by the blade 45. The excessive ink removing liquid containing the excessive printing ink can be removed perfectly from the contact roller 37 by the blade 45. The excessive ink removing liquid standing part (f) containing the printing ink (c) appears on the front side of the blade 45 in the rotating direction of the contact roller 37.

There reappears the film (a) of the excessive ink removing liquid without containing the printing ink (c) on the circumference 37*a* of the contact roller 37, after the excessive ink removing liquid passes through the blade 45. The contact roller 37 having the film (a) of the excessive ink removing liquid without containing the printing ink (c) comes into contact with a subsequent print image on the printing body P; therefore, the printing ink (c) having been transferred to the contact roller 37 does not blur the print image on the printing body P.

Since the position where the blade 45 is in contact with the circumference 37*a* of the contact roller 37 is on the front side of the top of the contact roller 37 in the rotating direction, when the liquid quantity in the excessive ink removing liquid standing part (f) exceeds a certain limit, even if the contact roller is rotating, the excessive ink removing liquid in the excessive ink removing liquid standing part (f) flows out by its weight in the reverse direction to the rotating of the contact roller 37. The overflowing excessive ink removing liquid is guided to flow on the slant surface of the sheet elastic body 49, and is recovered into the plate member 51.

As described above, the printing body P passes between the contact roller 37 and the facing roller the excessive part of the printing ink (b) forming the print image is removed reliably from the circumference 37*a* of the contact roller 37. Consequently, the occurrence of the set-off or seeping-through is reduced in the printing body already printed. When the print image surface is touched by a finger or the like immediately after being discharged, the print image gets immune from being deformed, and drying the printing ink (b) forming the print image can be done in a short period.

Next, the example 1 to example 3 which are more specific modes of the above-mentioned embodiments, and the comparison example will be described.

(EXAMPLE 1)

Figure 2:
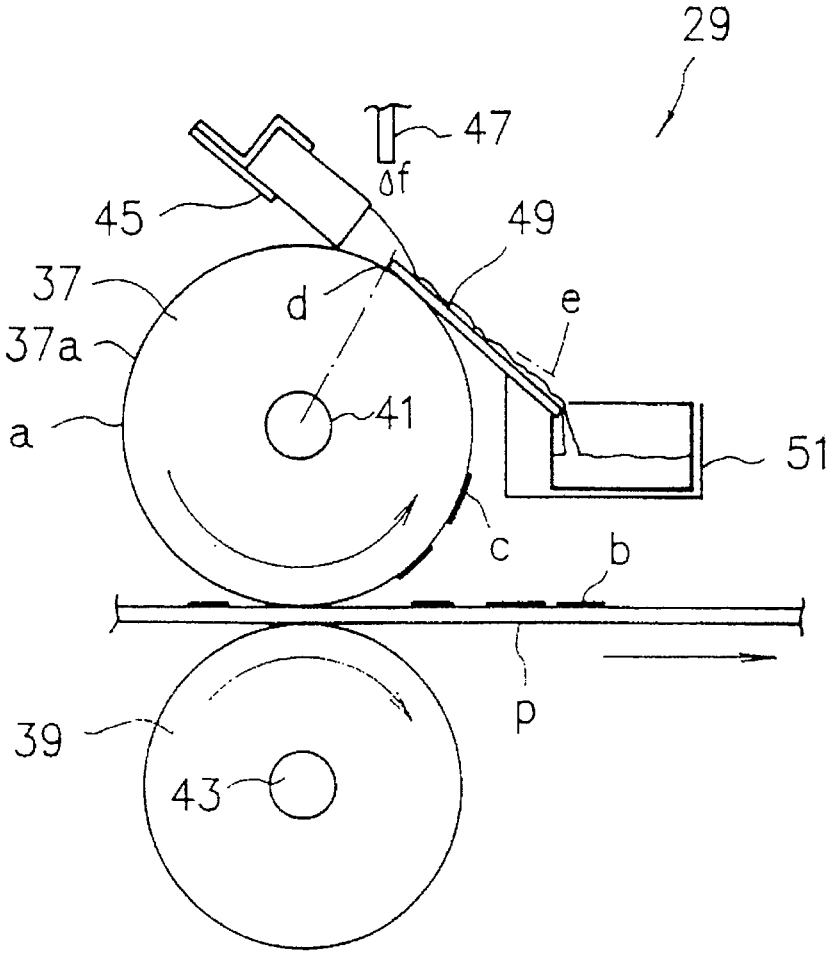
FIG. 2 is an enlarged plan view of the print image treatment device in FIG. 1.

The device in the above-mentioned embodiment as in FIG. 2 is set to a stencil printing machine (registered trademark, RISOGRAPH RA 205, manufactured by RISO KAGAKU Corporation). After the baking treatment by polytetrafluoroethylene (P.T.F.E) is applied to the aluminum roller surface of the contact roller, the polishing treatment is applied. The contact roller as treated above was used by setting the nip width between the contact roller and the facing roller to 0.5 mm.

Using a dimethylsiliconoil (KF-96, viscosity: 100 cps, manufactured by Shin-Etsu Chemical Company, Ltd.) for the excessive ink removing liquid, the stencil printing was conducted by adjusting the doctor blade setting condition so as to regulate the application quantity of the excessive ink removing liquid to 1 (mg/B4).

(EXAMPLE 2)

Using a similar device to the example 1, the experiment was conducted in the same manner as in the example 1, aside from setting the nip width between the contact roller and the facing roller to 3 mm.

(EXAMPLE 3)

Using a similar device to the example 1, the experiment was conducted in the same manner as in the example 1, aside from setting the nip width between the contact roller and the facing roller to 5 mm.

(Comparative Example 1)

Using a similar device to the example 1, the experiment was conducted in the same manner as in the example 1, aside from setting the nip width between the contact roller and the facing roller to 0.3 mm.

After the sheet passes through the device in the embodiment as illustrated in FIG. 2, the evaluation for the foregoing experiments, example 1 to example 3, and comparison case 1, was conducted as to the two points: whether or not the print image is deformed by finger-rubbing (rubbing resistance), and whether or not the set-off occurs. The evaluation results are shown in FIG. 5.

[Criteria for Evaluation]

Deformation of printing image (Rubbing Resistance)

O: after passing through the device of this invention, not deforming the print image and hardly transferring the printing ink to fingers by finger-rubbing.

X: after passing through the device of this invention, deforming the print image and transferring the printing ink to fingers by finger-rubbing.

Set-off Resistance

O: non-occurrence of a set-off in a continuous printing.

X: occurrence of a set-off in a continuous printing.

Figure 4:
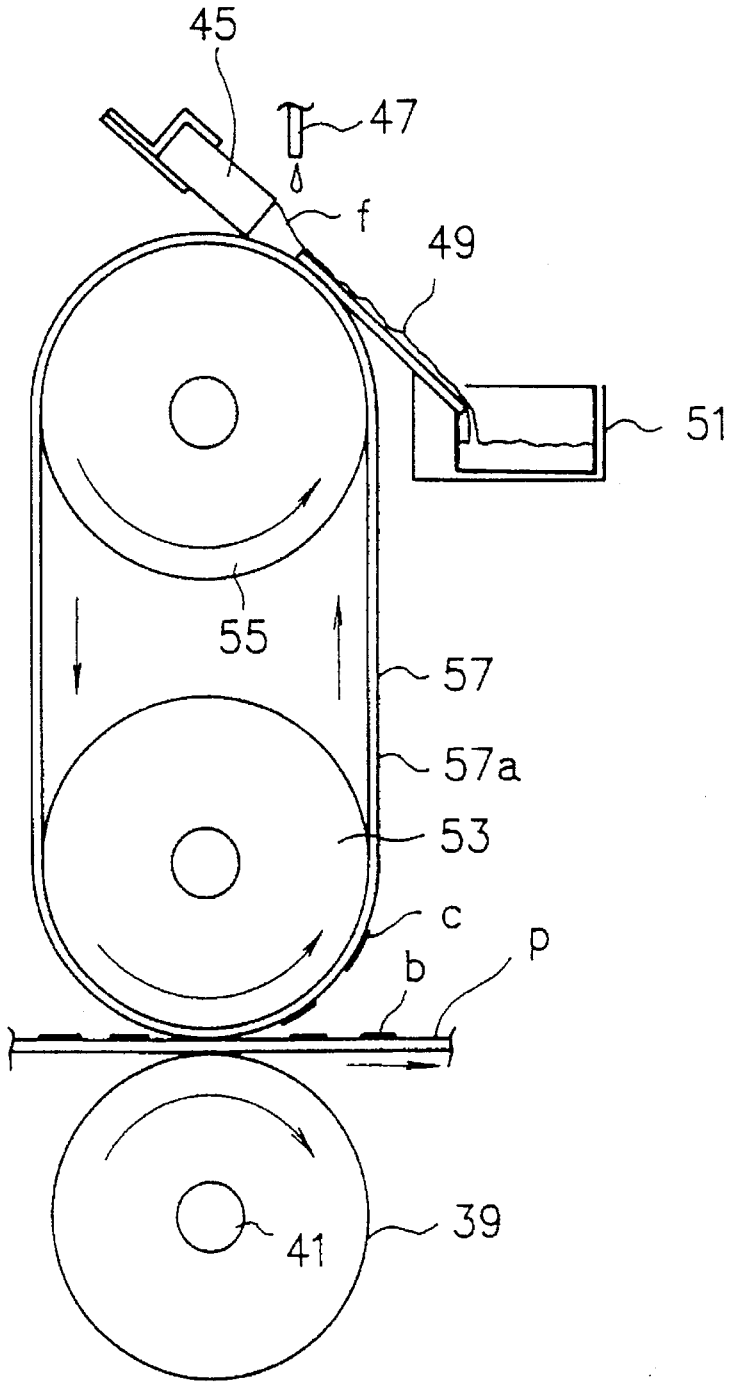
FIG. 4 is a plan view illustrating another constitution of the print image treatment device of the present invention.

Next, another embodiment based on the present invention will now be described with reference to FIG. 4. The description will be omitted as to the parts given the same symbol numbers in FIG. 4 as in FIG. 2. In this embodiment, a flexible endless belt 57 for a contact member is put on to bridge two rollers 53 and 55 placed separately in an upper and a lower position, with a certain tension applied. This embodiment will produce a similar effect to the foregoing embodiment.

When the print image has a plenty of the excessive printing ink as in the stencil printing (for instance, the thickness of the excessive ink is not less than 10 μm), it is recommended to set the nip width between the belt 57 and the facing roller 39 to more than 1.5 mm. Thus, the nip width will selectively be set according to the difference of the printing system which causes a difference in the application thickness of the printing ink forming the print image on the printed body.

According to the present invention, the printing body is pressed to the contact member by the facing member; the print image thereon comes into contact with the excessive ink removing liquid on the surface of the belt. This contact will completely remove the excessive printing ink forming the print image on the printing body. Therefore, the set-off or the seeping-through will reliably be prevented without other defects involved, and the print image will hardly be deformed by finger-rubbing.

The excessive ink removing liquid does not dissolve in the printing ink forming the print image, and is a liquid having a lower surface tension than that of the printing ink. Thus, the excessive part of the printing ink having been transferred to the excessive ink removing liquid is in a floating state on the surface of the excessive ink removing liquid. The excessive printing ink being in a floating state on the surface of the excessive ink removing liquid is removed by a cleaning means such as a blade for scraping off the excessive ink, which contacts the circumference of the contact roller.

The nip width formed by the contact member and the facing member is specified to be 0.5 mm or over; therefore, the quantity of the excessive printing ink transferred to the contact member becomes nearly constant, and the excessive printing ink on the printed body is removed almost perfectly; and therefore, the print image is not deformed by finger-rubbing.

What is claimed is:

1. A print image treatment device comprising:

a contact member on a surface of which an excessive ink removing liquid not dissolving in a printing ink forming a print image and having a surface tension lower than that of the printing ink is applied, said contact member being driven to rotate;

a facing member for bringing a printed surface of a printing body into contact with the excessive ink removing liquid on the contact member by nipping and carrying the printing body having been printed between the contact member and the facing member;

supply means for supplying the excessive ink removing liquid to the contact member; and cleaning means for removing an excessive ink with the excessive ink removing liquid, a dimension where the contact member and the facing member contact in the direction of the printing body to be carried being specified to be 0.5 mm or over.

2. A print image treatment device according to claim 1, wherein at least one of the contact member and the facing member is comprised of an elastically deformable material, the contact member and the facing member come into contact with each other while not carrying the printing body, and at least one of the contact member and the facing member deforms elastically.

3. A print image treatment device according to claim 2, wherein the cleaning means is formed of a plate member being in contact with a surface of the contact member on the front side of the top, in the rotating direction of the contact member.

4. A print image treatment device according to claim 3, wherein the supply means supplies the excessive ink removing liquid on the surface of the contact member on the front side of the contact position formed by the plate member and the contact member, in the rotating direction of the contact member.

5. A print image treatment device according to claim 4, wherein the cleaning means further includes a sheet elastic body for recovering the excessive ink removing liquid contacting the surface of the contact member on the front side of the contact position formed by the plate member and the contact member, in the rotating direction of the contact member.

6. A print image treatment device according to claim 5, wherein an end part of the sheet elastic body comes into close contact with a surface of the contact member with a specified length, and a rear part thereof is placed at a lower position to guide downward the excessive ink removing liquid on the surface of the contact member.

7. A print image treatment device according to claim 1, wherein the contact member has an endless belt and a plurality of rollers for carrying the belt.

8. A print image treatment device according to claim 1, wherein the contact member is a contact roller to nip the printing body having been printed between the facing member and the contact member.

* * * * *